US009988789B2

(12) United States Patent
Cross

(10) Patent No.: US 9,988,789 B2
(45) Date of Patent: Jun. 5, 2018

(54) EARTH REMOVAL AND SAND MINING SYSTEM AND METHOD

(71) Applicant: Crossworks, LLC, Erath, LA (US)

(72) Inventor: Leslie M. Cross, Erath, LA (US)

( * ) Notice: Subject to any disclaimer, the term of this patent is extended or adjusted under 35 U.S.C. 154(b) by 0 days. days.

(21) Appl. No.: 15/397,255

(22) Filed: Jan. 3, 2017

(65) Prior Publication Data

US 2017/0191242 A1 Jul. 6, 2017

Related U.S. Application Data

(60) Provisional application No. 62/275,424, filed on Jan. 6, 2016.

(51) Int. Cl.
*E02F 3/88* (2006.01)
*E02F 9/06* (2006.01)

(52) U.S. Cl.
CPC ..... *E02F 3/8833* (2013.01); *E02F 9/065* (2013.01)

(58) Field of Classification Search
CPC ... E02F 3/00; E02F 3/88; E02F 3/8833; E02F 3/8841
USPC ..... 37/307, 317
See application file for complete search history.

(56) References Cited

U.S. PATENT DOCUMENTS

| | | | | |
|---|---|---|---|---|
| 2,300,680 | A * | 11/1942 | Lyons | E02F 3/88 299/9 |
| 4,928,616 | A | 5/1990 | Robishaw | |
| 5,072,991 | A | 12/1991 | Rohr | |
| 8,327,789 | B2 | 12/2012 | Emch | |
| 8,935,864 | B2 * | 1/2015 | Halkyard | E02F 3/905 37/345 |
| 9,003,988 | B2 | 4/2015 | Khachaturian | |
| 2005/0017513 | A1 * | 1/2005 | Sipp | F03B 17/063 290/54 |

* cited by examiner

*Primary Examiner* — Gary S Hartmann
(74) *Attorney, Agent, or Firm* — Warner J. Delaune; Baker Donelson, et al.

(57) ABSTRACT

An earth removal and sand mining system is provided, comprising a modular floating platform having an elongated U-shaped open channel defining an operating area; a gantry positioned above the operating area, wherein the gantry includes a crane and trolley operable along a predefined path within the operating area; a hoist extending from the trolley; and a pump operatively suspended from the trolley, wherein the pump includes a slurry discharge hose. The platform includes an adjustable drag line connected to the pump to enable control of the pump position.

11 Claims, 4 Drawing Sheets

EARTH REMOVAL AND SAND MINING SYSTEM AND METHOD

CROSS-REFERENCE TO RELATED APPLICATIONS

This nonprovisional application claims priority under 35 U.S.C. 119(e) to U.S. Ser. No. 62/275,424, filed on Jan. 6, 2016.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

BACKGROUND OF THE INVENTION

1. Field of the Invention

The present invention relates generally to mining and dredging equipment, and more particularly to floating platforms used for earth removal and mining sand and other materials.

2. Description of Related Art

Conventional earth removal and sand mining from bodies of water typically requires the use of excavators positioned on the shore or on floating vessels or platforms, or heavy suction systems in similar locations. While such systems are effective in removing earth and sand, they can be imprecise if the area being mined requires a more systematic approach or more well defined removal. Furthermore, the prior systems can be difficult to manipulate or reposition. Therefore, an earth removal and sand mining system is needed that can be operated from a floating platform, easily positionable, capable of mining within a wide area, and able to remove materials along a desired contour of the earth.

SUMMARY OF THE INVENTION

In a more general embodiment, an earth removal and sand mining system is provided, comprising a floating platform having an elongated U-shaped open channel defining an operating area; a gantry positioned above the operating area, wherein the gantry includes a crane and trolley operable along a predefined path within the operating area; a hoist extending from the trolley; and a pump operatively suspended from the trolley, wherein the pump includes a slurry discharge hose.

In a more preferred embodiment, the platform includes at least one anchoring spud having a vertical axis.

In another preferred embodiment, the platform includes a hydraulic power unit adapted to provide hydraulic power to the crane, trolley, and other equipment.

In another embodiment, the platform includes a generator adapted to provide electrical power to the pump and other equipment.

In a more preferred embodiment, the trolley is operable along a horizontal path parallel to the operating area.

Preferably, the system further includes a pump hanger suspended from the trolley, and wherein the pump hanger has a pivotable connection to the pump.

More preferably, the platform includes a drag line connected to the pump, wherein the height of the drag line is adjustable.

In another embodiment, the drag line is operated from a drag spud residing within a spud well, and wherein the drag spud is adapted to anchor the floating platform.

In another embodiment, the floating platform can be pivoted in a horizontal plane around the vertical axis of the drag spud.

In yet another embodiment, the platform is constructed from modular and interlocking floating components.

BRIEF DESCRIPTION OF THE DRAWINGS

For a further understanding of the nature, objects, and advantages of the present invention, reference should be had to the following detailed description, read in conjunction with the following drawings, wherein like reference numerals denote like elements.

DETAILED DESCRIPTION OF THE INVENTION

Before the subject invention is further described, it is to be understood that the invention is not limited to the particular embodiments of the invention described below, as variations of the particular embodiments may be made and still fall within the scope of the appended claims. It is also to be understood that the terminology employed is for the purpose of describing particular embodiments, and is not intended to be limiting. Instead, the scope of the present invention will be established by the appended claims.

In this specification and the appended claims, the singular forms "a," "an," and "the" include plural reference unless the context clearly dictates otherwise. Unless defined otherwise, all technical and scientific terms used herein have the same meaning as commonly understood to one of ordinary skill in the art to which this invention belongs.

Figure 1:
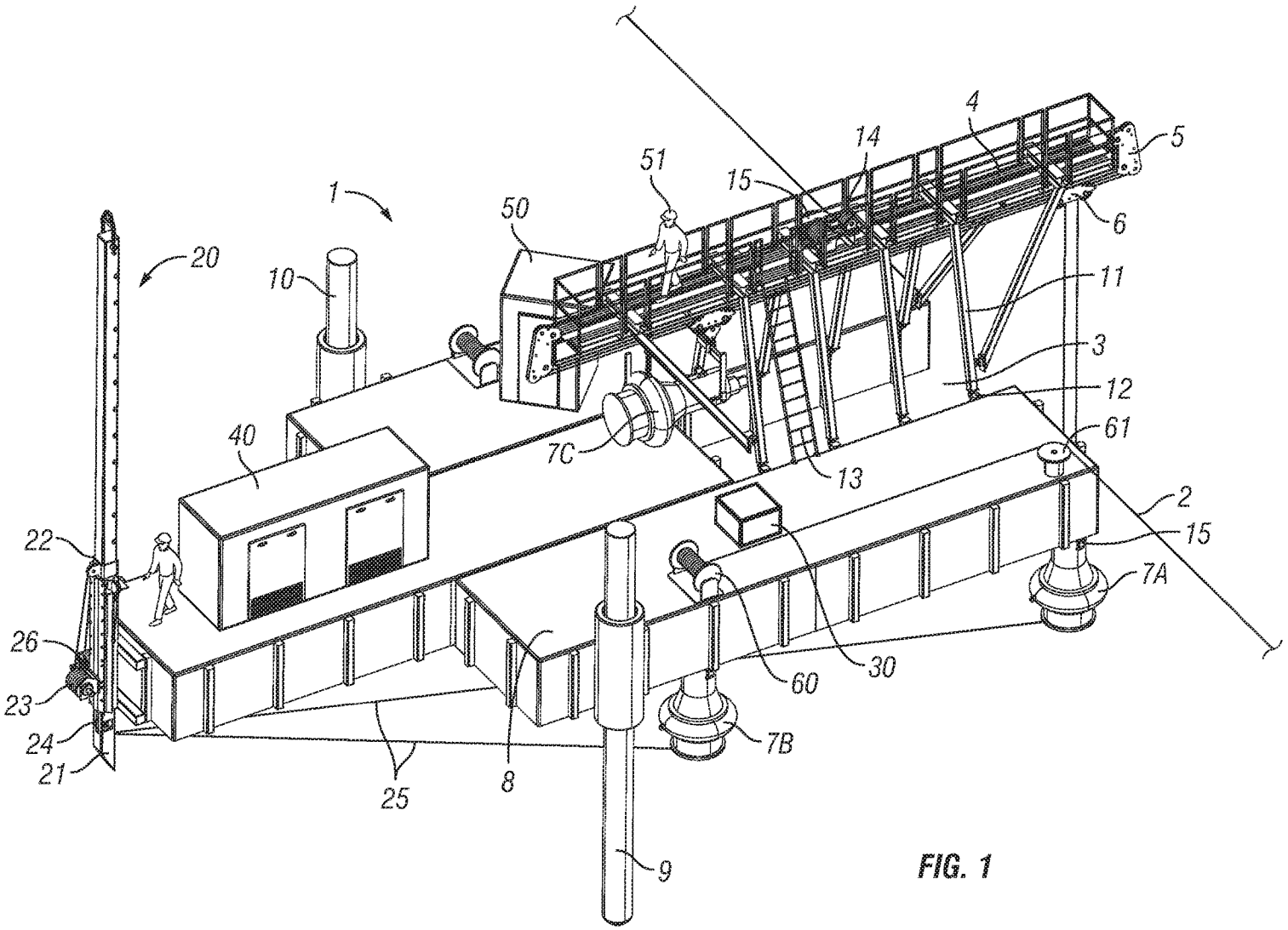
FIG. 1 shows a perspective view of a preferred embodiment of an earth removal and sand mining system.
Figure 2:
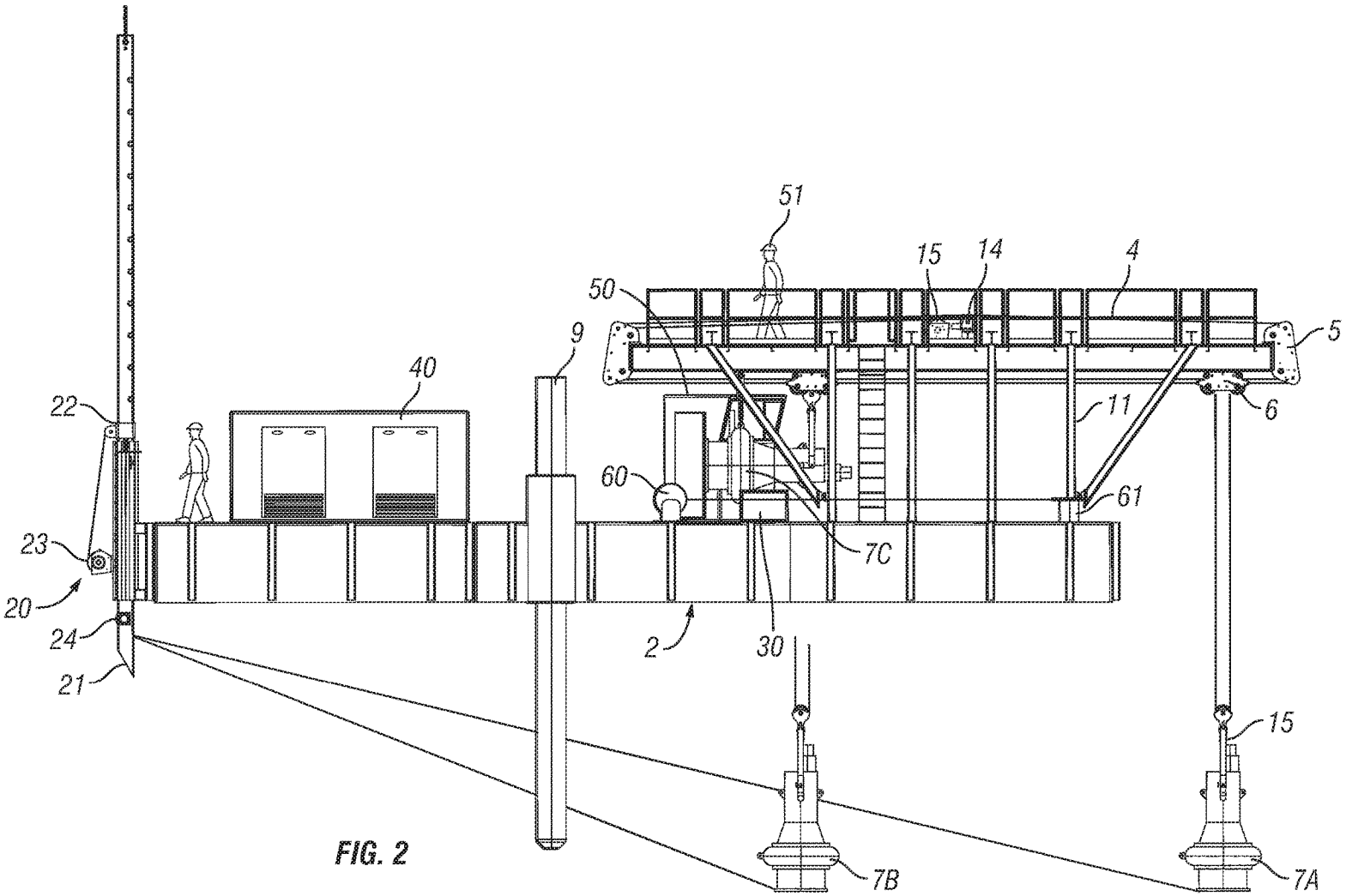
FIG. 2 shows an elevation view of the system of FIG. 1 with the pump in multiple positions relative to the platform.
Figure 3:
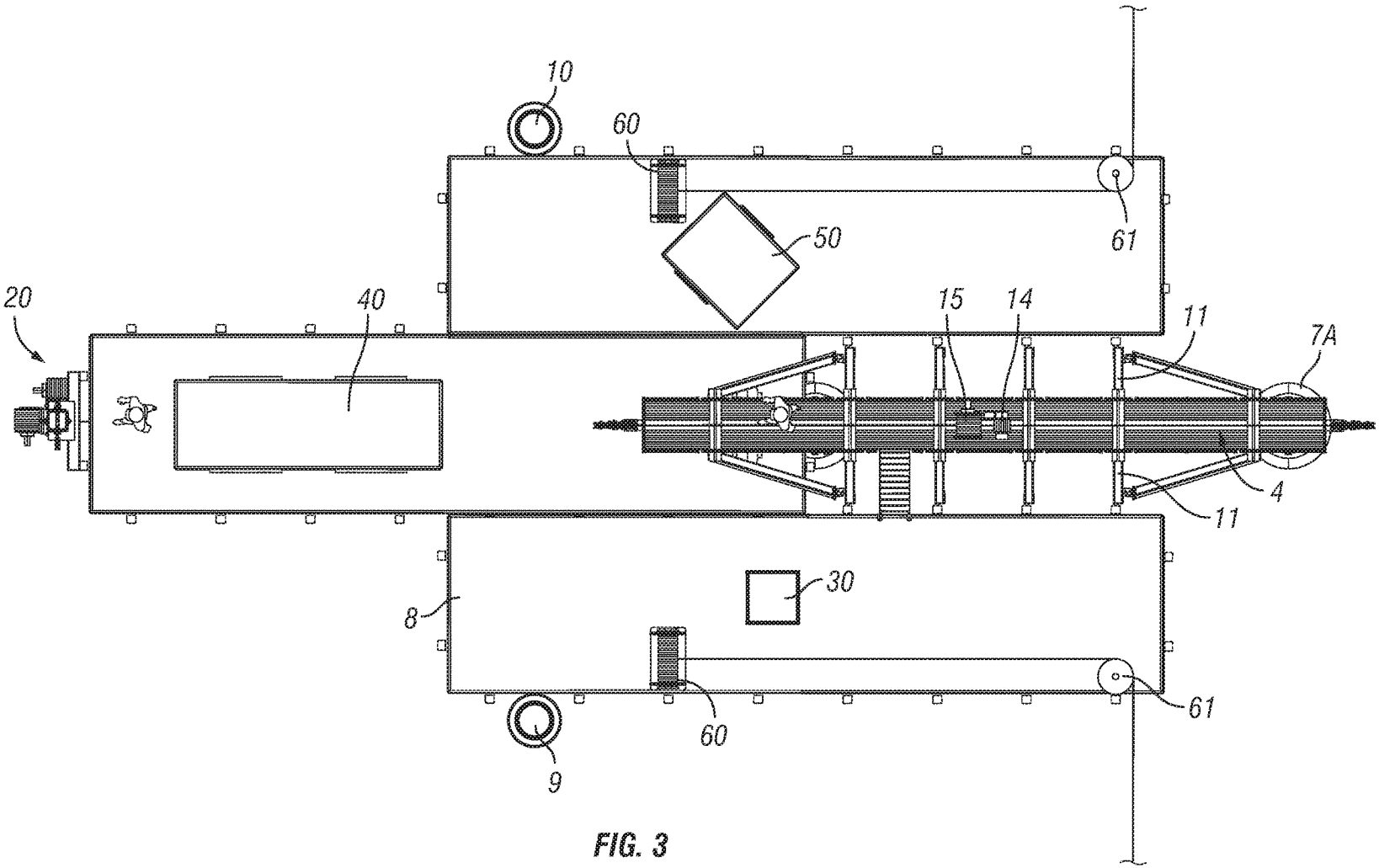
FIG. 3 shows a plan view of the system of FIG. 1.
Figure 4:
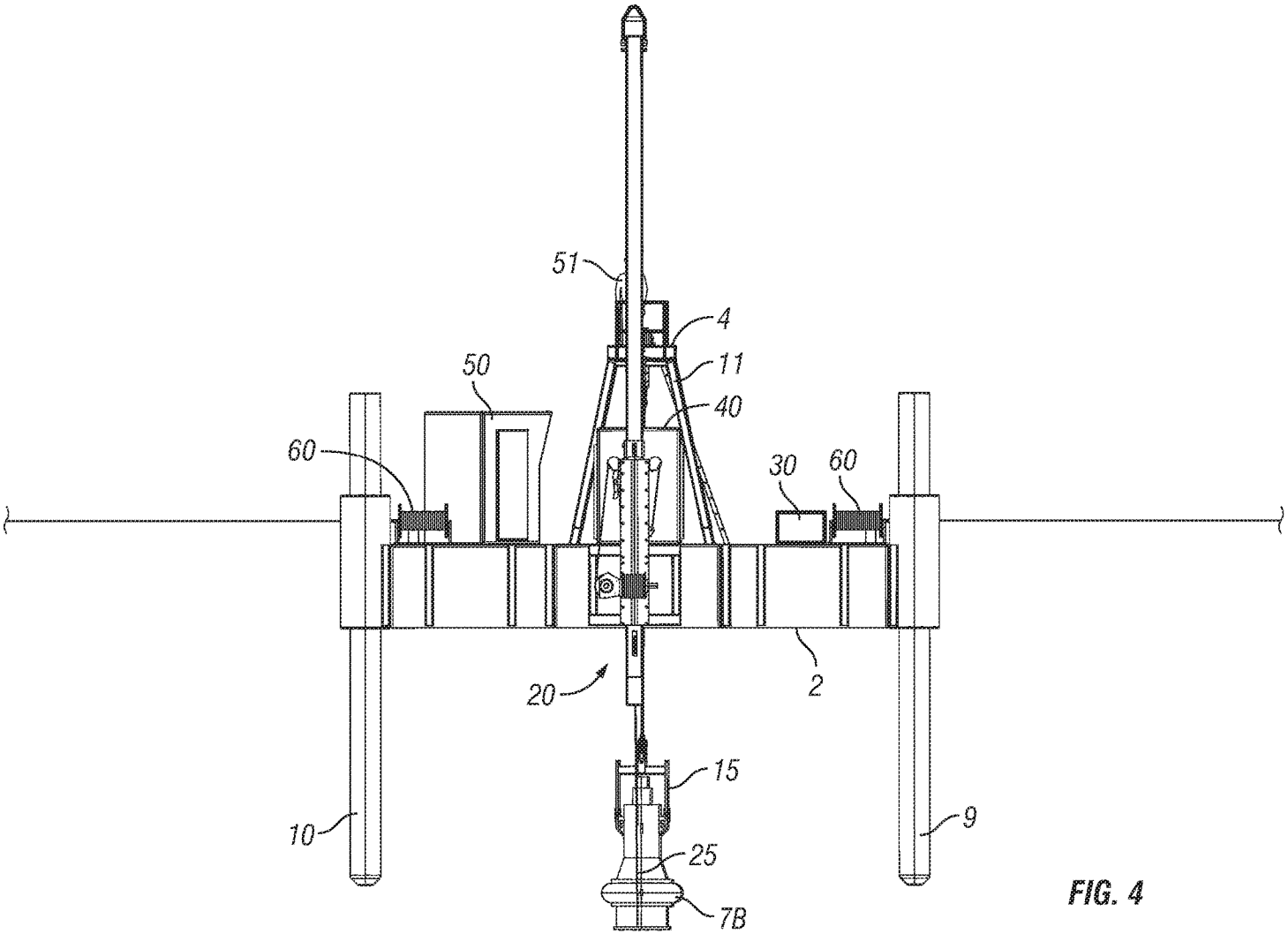
FIG. 4 shows a rear view of the system of FIG. 1.

Turning now to FIG. 1, the present invention is an earth removal and sand mining system 1 for removing such materials from a waterway. The system 1 generally comprises a floating platform 2 having an elongated U-shaped open channel 3 defining an operating area, a gantry 4 positioned above the operating area, wherein the gantry 4 includes a crane 5 upon which a trolley 6, shown in two extreme positions, is operable along the predetermined path over the operating area 3. The trolley 6 supports sheaves for multiple part cables to suspend a submersible pump 7. The pump 7 includes a slurry discharge hose (not shown for clarity) for removing earth, sand, and water as is commonly understood in the art. As will be explained in further detail below, the pump 7 is shown in three different positions 7A-7C to illustrate the maximum operating positions, as well as in a service or repair position.

The pump 7 is a hydraulically or electrically powered pump having agitators which create a slurry to keep the earth and sand suspended in the water during removal, such as those provided by Toyo Pumps North America Corporation. The pump 7 is suspended from the trolley 6 by a pivotable hanger system 15 which allows the pump 7 to be placed on its side for servicing.

The platform 2 is preferably comprised of an assembly of modular floating components which interlock with one another to form the desired shape or configuration of the platform 2. For example, the embodiment in the figures depicts a platform 2 which includes a main platform area 8 using three modular components to support various needed equipment to be described in further detail below. The U-shaped operating area 3 is established by two modular components extending from the main platform area 8. The main platform area 8 may be further extended or enlarged by adding more modular components as needed. Examples of suitable modular platform components are those manufactured under the trade name Flexifloat by Robishaw Engineering, Inc., or those manufactured by Poseidon Barge Corporation. In one embodiment, the platform 2 also includes at least one anchoring spud 9 having a vertical axis, and possibly a second spud anchoring system 10.

As will be explained in further detail below, the platform 2 includes a drag spud 21 which enables the platform 2 to be pivoted in a horizontal plane around the vertical axis of the drag spud 21 so that other areas can be mined in an arc around the drag spud 21. To assist in maneuvering the platform 2, at least two maneuvering winches 60 are positioned on opposite locations on the platform 2 having cables guided by a pulley 61. The maneuvering cables may be connected to an onshore location, another support vessel, or other fixed location as desired. Thus, the platform 2 can be pulled around the vertical axis of the drag spud 21 as needed to mine additional areas.

The gantry 4 is essentially a frame for supporting the crane 5 and trolley 6, and it is positioned above a plurality of support members 11 (a total of eight are shown) affixed to corresponding mounting lugs 12 present on the platform 2. The gantry 4 preferably includes a catwalk and safety railing for servicing the crane 5 and trolley 6, and can be accessed via a ladder 13 extending between the gantry 4 and the platform 2. Importantly, the gantry 4 and the crane 5 are designed to provide for both a maximum reach of the pump 7 for mining operations, as well as a service area located on the main platform area 8.

The trolley 6 is operated between its two maximum positions along the crane 5 by a cable spooled around a capstan-type winch 14. As can be seen in FIG. 1, the trolley 6 is operable along a horizontal path parallel to the operating area 3. The trolley 6 is supported by the crane 5 and is operated by a hoist winch 15. As stated above, the pump 7 is attached to the trolley 6 by a pivotable hanger 15. In this preferred configuration, the pump 7 can be used to remove earth and/or sand between maximum horizontal positions 7A and 7B, and can also be lifted by the trolley 6 and pivoted for servicing at position 7C.

In a preferred embodiment, the platform 2 further includes a drag line system 20 which is connected to the pump 7. The drag line system 20 comprises a drag spud 21 which can be moved vertically within a spud well 22 mounted to the platform 2. The drag spud 21 is raised and lowered within the spud well 22 by a spud winch 26 that carries a cable attached to the drag spud 21. The spud well 22 also includes a drag winch 23 and a lower pulley 24 for guiding a drag line cable 25 extending from the pump 7. Thus, as the pump 7 is moved along its operating path by the drag line cable 25, the trolley 6 is used to keep the pump 7 in an optimum vertical orientation for maximum suction efficiency. Importantly, the angle of operation of the pump 7 can be defined or changed by the vertical position of the lower pulley 24, which is caused by adjusting the position of the drag spud 21 relative to the spud well 22. This arrangement provides superior control over the operating path of the pump 7, because the crane 5, trolley 6, and drag line system 20 can be used cooperatively to mine along any desired topography of the sea bed or lake floor.

As will be understood, the platform 2 includes a hydraulic power unit (HPU) 30 adapted to provide the necessary hydraulic power to the winches and other hydraulically operated equipment. Suitable hydraulic lines (not shown for clarity) operatively connect the winches and other equipment to the HPU 30 as in common in the industry. The platform 2 further includes a diesel-powered generator 40 adapted to provide electrical power to the pump 7 and HPU 30 and any other electrical equipment required. A pilot house 50 may also be located on the platform 2 for the operator 51 to operate the various electrical and hydraulic controls located therein.

All references cited in this specification are herein incorporated by reference as though each reference was specifically and individually indicated to be incorporated by reference. The citation of any reference is for its disclosure prior to the filing date and should not be construed as an admission that the present invention is not entitled to antedate such reference by virtue of prior invention.

It will be understood that each of the elements described above, or two or more together, may also find a useful application in other types of methods differing from the type described above. Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention set forth in the appended claims. The foregoing embodiments are presented by way of example only, and the scope of the present invention is to be limited only by the following claims.

The invention claimed is:

1. A earth removal and sand mining system, comprising:

(a) a floating platform having an elongated U-shaped open channel defining an operating area;

(b) a gantry positioned above the operating area, wherein the gantry includes a crane and trolley mounted to the gantry, wherein the trolley is operable along a predefined path within the operating area;

(c) a hoist extending from the trolley; and (d) a pump operatively suspended from the trolley, wherein the pump includes a slurry discharge hose.

2. The system of claim 1, wherein the platform includes at least one anchoring spud having a vertical axis.

3. The system of claim 1, wherein the platform includes a hydraulic power unit adapted to provide hydraulic power to the crane, trolley, and other equipment.

4. The system of claim 1, wherein the platform includes a generator adapted to provide electrical power to the pump and other equipment.

5. The system of claim 1, wherein the trolley is operable along a horizontal path parallel to the operating area.

6. The system of claim 1, further including a pump hanger suspended from the trolley, and wherein the pump hanger has a pivotable connection to the pump.

7. The system of claim 1, wherein the platform includes a drag line connected to the pump.

8. The system of claim 7, wherein the height of the drag line is adjustable.

9. The system of claim 7, wherein the drag line is operated from a drag spud residing within a spud well, and wherein the drag spud is adapted to anchor the floating platform.

10. The system of claim 9, wherein the floating platform can be pivoted in a horizontal plane around the vertical axis of the drag spud.

11. The system of claim 1, wherein the platform is constructed from modular and interlocking floating components.

* * * * *